United States Patent [19]

More et al.

[11] 4,248,631

[45] Feb. 3, 1981

[54] CASTING POWDER FOR THE CONTINUOUS CASTING OF STEEL AND METHOD FOR PRODUCING THE SAME

[75] Inventors: Anton More, Burhausen, Fed. Rep. of Germany; Albert Tosin, Vienna, Austria

[73] Assignee: Wacker-Chemie GmbH, Munich, Fed. Rep. of Germany

[21] Appl. No.: 74,223

[22] Filed: Sep. 10, 1979

[30] Foreign Application Priority Data

May 2, 1979 [DE] Fed. Rep. of Germany ..... 2917763

[51] Int. Cl.[3] ..... C22B 9/10

[52] U.S. Cl. ..... 75/257; 75/53; 164/56

[58] Field of Search ..... 75/257, 52–58; 148/26; 164/56

[56] References Cited

U.S. PATENT DOCUMENTS

| | | | |
|---|---|---|---|
| 3,959,031 | 5/1976 | More | 148/26 |
| 3,984,236 | 10/1976 | Koenig | 75/257 |
| 4,038,067 | 7/1977 | Takeuchi | 75/257 |
| 4,066,478 | 1/1978 | DeHaeck | 148/26 |

*Primary Examiner*—P. D. Rosenberg

*Attorney, Agent, or Firm*—Allison C. Collard; Thomas M. Galgano

[57] ABSTRACT

A casting powder for the continuous casting of steel on the basis of silicate slags having the chemical analysis

| | |
|---|---|
| 25–45% by wt. of $SiO_2$ | 20–45% by wt. of CaO |
| 1–16% by wt. of $Al_2O_3$ | 0.1–15% by wt. of MgO |
| 0.1–1.5% by wt. of FeO | (20–45.1% by wt. of CaO + MgO) |
| 0.05–10% by wt. of $TiO_2$ | 3–15% by wt. of $Na_2O + K_2O$ |
| 0.05–10% by wt. of MnO | 0–7% by wt. of $B_2O_3$ |
| | 3–10% by wt. of bound F |

which may as well include impurities from the raw materials. The slag is premelted, foamed to a bulk weight of 0.5 to 1.4 kg/l, preferably 0.8–1.2 kg/l and coated superficially with a layer of 1.5 to 15% by weight, preferably 2 to 6%, of carbon black and/or graphite with the aid of an appropriate adhesive.

8 Claims, No Drawings

CASTING POWDER FOR THE CONTINUOUS CASTING OF STEEL AND METHOD FOR PRODUCING THE SAME

The present invention relates to a casting powder for the continuous casting of steel based on silicate slags of the following chemical analysis

| | |
|---|---|
| 25–45% by wt. of $SiO_2$ | 20–45% by wt. of CaO |
| 1–16% by wt. of $Al_2O_3$ | 0.1–15% by wt. of MgO |
| 0.1–1.5% by wt. of FeO | (20–45.1% by wt. of CaO + MgO) |
| 0.05–10% by wt. of $TiO_2$ | 3–15% by wt. of $Na_2O + K_2O$ |
| 0.05–10% by wt. of MnO | 0–7% by wt. of $B_2O_3$ |
| | 3–10% by wt. of bound F |

which may as well include impurities from the raw materials. The present invention also relates to a method for producing a casting powder for the continuous casting of steel.

In general, for the continuous casting of steel, the casting powders are fed into the continuous casting mold in order to protect the liquid steel entering through an immersion tube against reoxidation; to dissolve the rising oxidic inclusions; and to provide a lubricating film between the solidifying steel body and the continuous casting mold. For this purpose, mixtures of finely ground, oxidic or carbonaceous raw materials are usually employed. These mixtures may additionally contain a small percentage of graphite, in order to prevent early sintering together of the powder particles upon heating or to prevent the formation of lumps (see U.S. Pat. No. 3,964,916).

The mixed casting powders are awkward to handle, because due to their being so finely ground, they tend to form heavy dust clouds when poured into the continuous casting mold.

If to avoid this shortcoming an attempt is made to suspend the materials in water and then to spray them through a suitable device, small balls of casting powder will be formed which of necessity will contain a smaller or larger amount of moisture. This proves to be quite disadvantageous when the casting powder gets into contact with the liquid steel and the latter absorbs hydrogen formed by chemical reaction of the water.

When the above-mentioned powders are used in practice, they all have a common shortcoming: the powders form larger or smaller lumps at the bath surface before a continuous molten layer of slag is formed. The lumps adhere to the rim of the mold and form the dreaded "slag strings", which make impressions on the surface of the steel strand. The faults on the surface of the steel castings have to be removed either by scarfing or grinding, which incurs considerable expense.

It is therefore an object of the invention to provide a casting powder and a method for producing the same, the use of which avoids the formation of the dreaded slag strings so that the surface of the steel castings will be as fault-free as possible.

According to the invention, this object is fulfilled by a casting powder based on the above-described slag composition which is initially melted and foamed, ground to a grain size of maximally 5 mm and passed through a sieve and wherein the individual particles are then coated, by means of an adhesive with a layer consisting of 1.5 to 15% by weight of carbon black and/or graphite.

The choice of the slag composition within the limits mentioned depends in each individual case on the casting conditions, the type of the continuous steel casting plant, and the steel cast.

The preparation of the powders according to the invention can be carried out as follows.

Slag of the desired composition is melted, e.g. in an electric furnace. The superheated melt is subsequently foamed, by pouring it into water, to achieve a bulk weight of 0.5 to 1.4 kg/l, preferably 0.8 to 1.2 kg/l. The granulate obtained is dried, ground to the desired grain size and passed through a sieve, until the following particle sizes are obtained: at least 95% by weight of particles between 0.05 and 5 mm, preferably at least 98% by weight within 0.1 and 2 mm, with a balance of at most 5% or 2% by weight of fine dust, respectively. Subsequently, the premolten, ground and screened slag is coated in a mixer with 1.5 to 15% by weight, preferably 2 to 6%, of carbon black and/or graphite with the aid of an adhesive. Organic or inorganic adhesives may be used. Adhesives based on polyvinyl acetate or polyvinyl alcohol in aqueous or alcoholic solutions or suspensions having proved most successful. Depending on the adhesive used, the necessary amount is usually 0.3 to 3% by weight, referring to the weight of slag, in dependence on the carbon quantities used. Using, e.g. the preferred amount of 2 to 6% by weight of carbon black and/or graphite, as the carbon component of the coating, lower quantities of 0.4–1% by weight of adhesive will be sufficient.

When the casting powders of the invention are used, the otherwise very unpleasant formation of smoke upon introduction of the powder is prevented. When the powder is melted in the ingot mold no bad-smelling odors are formed, which frequently result from the use of the conventional casting powders to the considerable annoyance of the operational personnel. Another important advantage is the absence of dust when they are poured into the ingot mold.

The use of the conventional casting powders is accompanied by formation of a large zone between the molten slag layer above the metal level and the unmolten casting powder, the zone being filled with a bubbling mass of gas-emitting particles, which are partly sintered together and partly in liquid-melt condition. This boiling above the melt level makes it difficult for the operators to maintain a definite even or uniform level of the steel in the ingot mold.

It is, therefore, an important advantage of the powder according to the invention, as compared to the conventional powders, that when poured into the mold they will be distributed evenly above the metal level and that there will be no formation of the dreaded slag strings. Even the expert in this field is surprised by the fact that only a very thin layer of molten casting powder slag is formed above the metal level and the supernatant powder particles remain apparently unchanged. This makes it possible to maintain a certain definite level of liquid steel in the ingot mold, a fact which positively improves the quality of the cast body of steel.

In the following, the invention will be more fully described in a number of examples, which are given by way of illustration and not of limitation.

EXAMPLE 1

Steel of the following analysis: 0.06% by weight of C, 0.02% by weight of Si; and 0.35% by weight of Mn, was cast into a slab of 1000×210 mm at a casting rate of 1.6 m/minute. This steel is a deep-drawing grade for manufacturing thin sheets for car bodies.

The slag used in this case has the following composition:

| | |
|---|---|
| 37.9% by wt. of $SiO_2$ | 35.3% by wt. of CaO |
| 2.0% by wt. of $Al_2O_3$ | 4.8% by wt. of MgO |
| 0.3% by wt. of FeO | 4.7% by wt. of $B_2O_3$ |
| 0.6% by wt. of $TiO_2$ | 9.2% by wt. of $Na_2O$ |
| 1.9% by wt. of Mno | 0.1% by wt. of $K_2O$ and |
| | 4.4% by wt. of bound fluorine |

The percentages add up to an amount above 100% since the cations, following analytical practice, are always calculated on oxygen, though they are not necessarily present as oxidic compounds in the slag, but may also be present at least partly as fluorides, especially as far as calcium, sodium and magnesium are concerned; this is indicated by the 4.4% by weight of flourine in the analysis.

The granular silicate foamed to a bulk weight of about 1 kg/l, was screened to a grain size of 0.1 to 1.5 mm and was coated with 4% of carbon black by means of 0.6% by weight of a 10% aqueous polyvinyl alcohol.

This powder for continuous casting of steel was used when the above-mentioned steel was cast, in an amount of 493 tons.

The powder consumption was 0.4 kg/t of cast steel. The slabs cast with the aid of the casting powder of the invention had an excellent surface quality which, when classified with the conventional marks, were designated as good and very good. The surface of the slabs was particularly free of corner and surface cracks. Except for the portion cast initially, no pores or inclusions were found, such as which frequently appear when steel so rich in aluminum is cast. The yield was considerably higher than with that conventionally obtained due to the higher quality and excellent surface of the slabs.

EXAMPLE 2

Steel of the following analysis was cast: 0.08% C; 0.5% Si; 1.5% Mn; and 1% Cr. This steel is of a quality for plates, from which welded pipes are made. The slabs cast had the following size: 1600×210 mm. The casting rate was 1.2 m/minute.

For this experiment a slag of the following composition was made:

| | |
|---|---|
| 33.4% by wt. of $SiO_2$ | 2.9% by wt. of MnO |
| 9.4% by wt. of $Al_2O_3$ | 37.3% by wt. of CaO |
| 0.3% by wt. of FeO | 5.4% by wt. of MgO |
| 2.4% by wt. of $TiO_2$ | 5.1% by wt. of $Na_2O$ |
| | 6.0% by wt. of bound fluorine |

The slag was foamed to a bulk weight of 0.9 kg/l, ground to a grain size of 0.1 to 2 mm, and coated with 6% by weight of equal parts of carbon black and graphite, calculated on the weight of the slag; the coating being performed with the aid of 0.8% by weight of 10% aqueous polyvinyl alcohol.

With the so obtained casting powder 250 tons of the above-mentioned steel were cast. The powder consumption was 0.45 kg/t. The surface of the slabs obtained was superior to that of the ones made with the use of conventional, mixed casting powders.

A comparison test made with the use of pre-melted slag of the same composition, which had been ground to a size smaller than 0.3 mm and mixed with 3% soot and 3% graphite, resulted in poor slab surfaces. Particularly, there were thick lines of slag at the oscillation marks.

EXAMPLE 3

The steel cast had the following composition: 0.6% by weight of C; 0.3% by weight of Si; and 0.6% by weight of Mn. The steel quality is one for making very thin, hard wires. Cast were billets of 120×120 mm, the casting rate was 2 m/minute. The slag used in this case had the following composition:

| | |
|---|---|
| 37.0% by wt. of $SiO_2$ | 25.4% by wt. of CaO |
| 15.1% by wt. of $Al_2O_3$ | 5.1% by wt. of MgO |
| 0.6% by wt. of FeO | 5.8% by wt. of $Na_2O$ |
| 0.4% by wt. of $TiO_2$ | 1.6% by wt. of $K_2O$ |
| 5.0% by wt. of MnO | 5.6% by wt. of bound fluorine |

The slag was foamed to a bulk weight of 1.3 kg/l, ground to grain size 0.1–0.5 mm and coated with a mixture of 12% by weight of equal parts of carbon black and graphite with the aid of 2.5% by weight of 10% aqueous polyvinyl alcohol.

The billets obtained had a much better surface quality than those made by means of conventional mixed casting powders. This was proved by the fact that the weight loss upon grinding the billets made with the powder according to the invention only amounted to about 4% whereas with the use of conventional mixed casting powder a weight loss of about 7–8% had to be expected.

While only several examples of the present invention have been described, it will be obvious that many modifications and changes may be made therein, without departing from the spirit and scope of the invention.

What is claimed is:

1. A casting powder for the continuous casting of steel based on silicate slags of the following chemical analysis

| | |
|---|---|
| 25–45% by wt. of $SiO_2$ | 20–45% by wt. of CaO |
| 1–16% by wt. of $Al_2O_3$ | 0.1–15% by wt. of MgO |
| 0.1–1.5% by wt. of FeO | (20–45.1% by wt. of CaO + MgO) |
| 0.05–10% by wt. of $TiO_2$ | 3–15% by wt. of $Na_2O + K_2O$ |
| 0.05–10% by wt. of MnO | 0–7% by wt. of $B_2O_3$ |
| | 3–10% by wt. of bound F |

wherein the powder is pre-melted and foamed, then ground and passed through a sieve to ensure a maximum grain size of 5 mm, whereupon the grains are coated, by means of an adhesive, with a layer of 1.5 to 15% by weight of a member selected from the group consisting of carbon black and graphite and a mixture thereof.

2. The casting powder according to claim 1, wherein the bulk weight obtained by foaming is between 0.8 and 1.2 kg/l.

3. The casting powder according to claim 1 wherein the grain size is at most 2 mm and for 98% by weight of the individual grains, the minimum grain size is 0.1 mm.

4. The casting powder according to claim 1, wherein the individual grains are coated with 2–6% by weight of said member selected from the group consisting of carbon black, graphite and a mixture thereof.

5. A method for producing a casting powder for the continuous casting of steel based on a silicate slag with the following chemical analysis

| | |
|---|---|
| 25–45% by wt. of $SiO_2$ | 20–45% by wt. of CaO |
| 1–16% by wt. of $Al_2O_3$ | 0.1–15% by wt. of MgO |
| 0.1–1.5% by wt. of FeO | (20–45.1% by wt. of CaO + MgO) |
| 0.05–10% by wt. of $TiO_2$ | 3–15% by wt. of $Na_2O + K_2O$ |
| 0.05–10% by wt. of MnO | 0–7% by wt. of $B_2O_3$ |
| | 3–10% by wt. of bound F |

the steps comprising:

initially melting and foaming a powder having the aforementioned slag chemical analysis to produce a foamed slag;

grinding said foamed slag to produce grains;

passing said grains through a sieve so a maximum grain size of 5 mm is achieved; and coating said grains with a layer of 1.5 to 15% by weight of a member selected from the group consisting of carbon black, graphite and a mixture thereof.

6. The method according to claim 5, wherein the bulk weight obtained by foaming is between 0.8 and 1.2 kg/l.

7. The method according to claim 5, wherein the grain size is at most 2 mm, and for 98% by weight of the individual grains, the minimum grain size is 0.1 mm.

8. The method according to claim 5, wherein the individual grains are coated with 2–6% by weight of said member selected from the group consisting of carbon black, graphite and a mixture thereof.

* * * * *